United States Patent [19]

Van Valkenburg

[11] Patent Number: 4,875,595

[45] Date of Patent: Oct. 24, 1989

[54] STORAGE ENCLOSURE

[76] Inventor: N. L. Van Valkenburg, 624 Maulhardt Ave., Oxnard, Calif. 93030

[21] Appl. No.: 217,399

[22] Filed: Jul. 11, 1988

[51] Int. Cl.[4] ..... B65D 81/00

[52] U.S. Cl. ..... 220/1.5; 206/386

[58] Field of Search ..... 220/1.5, 1 C, 5 A, 68, 220/69, 408; 206/386, 446, 524.6

[56] References Cited

U.S. PATENT DOCUMENTS

| | | | |
|---|---|---|---|
| 1,099,603 | 6/1914 | Ingersoll | 220/408 X |
| 1,343,480 | 5/1920 | Rutherford . | |
| 1,396,719 | 11/1921 | Hull . | |
| 2,073,990 | 3/1937 | Koch . | |
| 2,410,338 | 10/1946 | Craine . | |
| 2,547,112 | 4/1951 | Daniels . | |
| 3,029,967 | 4/1962 | Morrison | 220/1.5 X |
| 3,490,632 | 1/1970 | McKinney . | |
| 3,623,631 | 11/1971 | Ford | 220/69 |
| 3,926,814 | 12/1975 | Hogarth . | |
| 4,015,715 | 4/1977 | Kelf | 206/386 X |
| 4,361,232 | 11/1982 | Olmsted . | |

FOREIGN PATENT DOCUMENTS

| | | | |
|---|---|---|---|
| 2717396 | 8/1978 | Fed. Rep. of Germany | 220/1 C |
| 7414833 | 11/1974 | Netherlands . | |
| 2156313 | 10/1985 | United Kingdom . | |

*Primary Examiner*—Steven M. Pollard

*Attorney, Agent, or Firm*—Poms, Smith, Lande & Rose

[57] ABSTRACT

A storage enclosure provided for storing containers of hazardous material with a secondary containment feature being provided by a one piece containment pan cradled within a support base frame work of support beams and side beams which also allow for visual inspection of the underside of the pan. The enclosure is of a very sturdy construction employing relatively heavy gauge steel sheets for side and rear wall panels mounted to panel supporting frames of tubular steel frame members. A pair of front doors are also made of steel panels secured to door frames of tubular steel construction. Footing channel members provide spaces for forklift mobility of the enclosure. The one piece panel roof and associated frame is secured by a friction fit to the enclosure side walls so that it may lift off when elevated internal pressures are experienced.

13 Claims, 5 Drawing Sheets

Fig. 6.
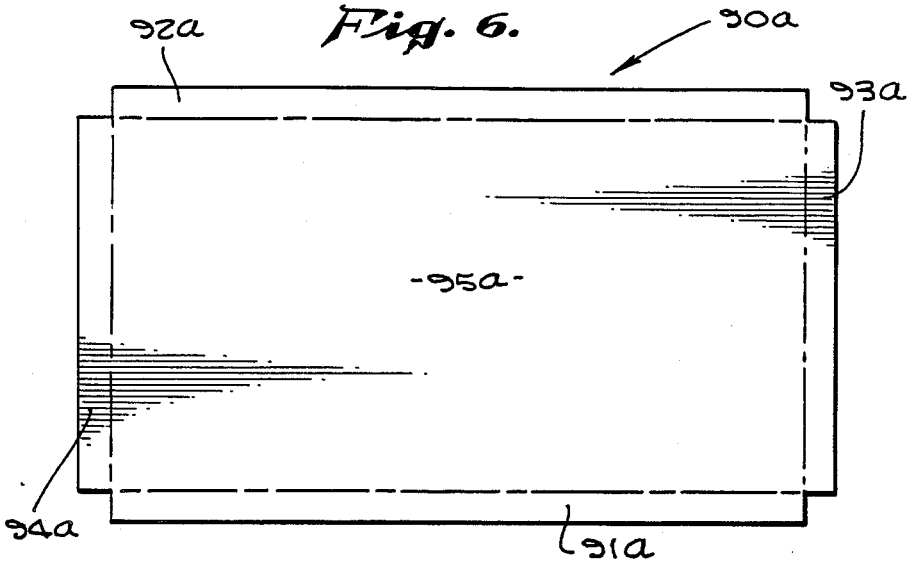
Fig. 7.
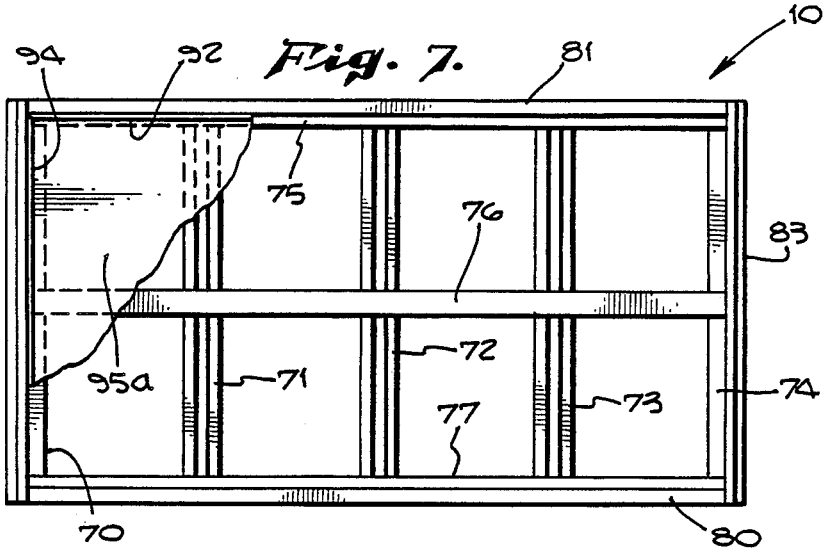
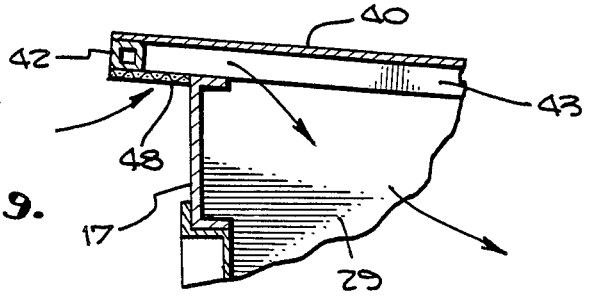
Fig. 9.

STORAGE ENCLOSURE

BACKGROUND OF THE INVENTION

Generally stated, the present invention relates to storage enclosures and more particularly to such enclosures for storing containers of hazardous material in such a manner that a secondary containment is provided for any spills or leakage of the containers within the enclosure.

The increased recognition of problems attendant the disposal of hazardous materials has caused a need for producers of hazardous material to treat the containment and storage of such materials with a greater degree of care than was employed some years ago. It is common to provide containers, such as drum containers and the like, for storing hazardous material before use and in other cases, after the hazardous materials have been produced, but prior to a disposal thereof. It is known to be desirable to provide enclosures for such containers so as to avoid contact therewith by members of the public and/or workers who might not appreciate the danger associated with such materials.

Accordingly, it is a primary object of the present invention to disclose and provide a storage enclosure for storing containers of hazardous material which provides for a secured and reliable secondary containment of any spills or leakage which might emanate from the containers stored within the enclosure. It is a further object of the present invention to provide such a storage container which is of strong durable steel construction in a manner so that unauthorized access to the containers within the enclosure can be minimized. It is a further object of the present invention to provide such an enclosure wherein the condition of the means for providing the secondary containment of the enclosure can be visually inspected to determine whether spills or leakage of stored materials have occurred and whether the structure continues to provide the desired containment.

SUMMARY OF THE INVENTION

Generally stated, the present invention in storage enclosure includes the provision of an enclosure having a base, a containment pan, side and rear walls, a front wall having at least one front door therein and a roof wherein the base includes a plurality of support beams providing a plurality of spaced support upper surfaces together with a plurality of side beams providing a plurality of side surfaces extending vertically upwardly of the support surfaces whereby such support surfaces and side surfaces together provide an open framework support in the base for receiving and supporting the containment pan in secured manner thereon. Preferably, the containment pan comprises a single sheet of metal formed into a receptacle having a integral bottom and surrounding upstanding side walls, such pan receptacle being seated upon the plurality of spaced support upper surfaces and within the plurality of side surfaces, the receptacle being cradled by the support frame work thus provided.

A removable wooden platform floor structure is also preferably provided to provide a spark free floor section to receive containers thereon, each of the sections having support runners which rest upon the receptacle bottom with a floor facing overlying all but portions of the runners, the exposed marginal end portions of the runners being generally adjacent a side wall of the receptacle and having a removable grate resting thereon to provide an entry to the containment pan for any spills and leakage of the containers. Further, a portion of the floor facing on at least one of the floor sections is preferably removable in order to provide a visual inspection of the interior of the containment pan beneath such floor section.

A strong structural enclosure is provided in accordance with the present invention through the use of relatively heavy gauge steel panels and associated tubular steel frames whereby each of the side walls and rear walls are formed of individual integral steel panels. Similarly the roof and front door panels are constructed of relatively heavy gauge steel sheets.

To facilitate relieving of any internal pressures which might build up within the enclosure, the roof, preferably fabricated of a steel panel with a supporting tubular steel frame, is held to the side walls of the enclosure by a friction fit which can be overcome by an internal pressure of more than a predetermined amount. The friction fit is provided by retention posts depending from the roof which are engaged within apertured retention blocks provided on the enclosures side wall interior surfaces. Furthermore, venting of the enclosure is provided by side wall vents in the enclosure side walls and through a portion of the roof which overhangs a front wall thereof.

A better understanding of the enclosure structure in accordance with the present invention, as well as a recognition of additional advantages and objects thereof, will be afforded to those skilled in the art from a consideration of the following detailed description of a preferred exemplary embodiment thereof. Reference will be made to the appended sheets of drawings which will be first described briefly.

BRIEF DESCRIPTION OF THE DRAWINGS

FIG. 6 is a plan view of a single sheet of steel stock employed in fabricating the hazardous material containment pan of the enclosure of FIGS. 1 through 5.

FIG. 7 is a plan view of the base support frame work for the enclosure of FIGS. 1 through 5.

FIG. 9 is a detail section view of a portion of the front wall and roof of the enclosure of FIGS. 1 through 8.

DETAILED DESCRIPTION OF THE PREFERRED EXEMPLARY EMBODIMENT

Figure 1:
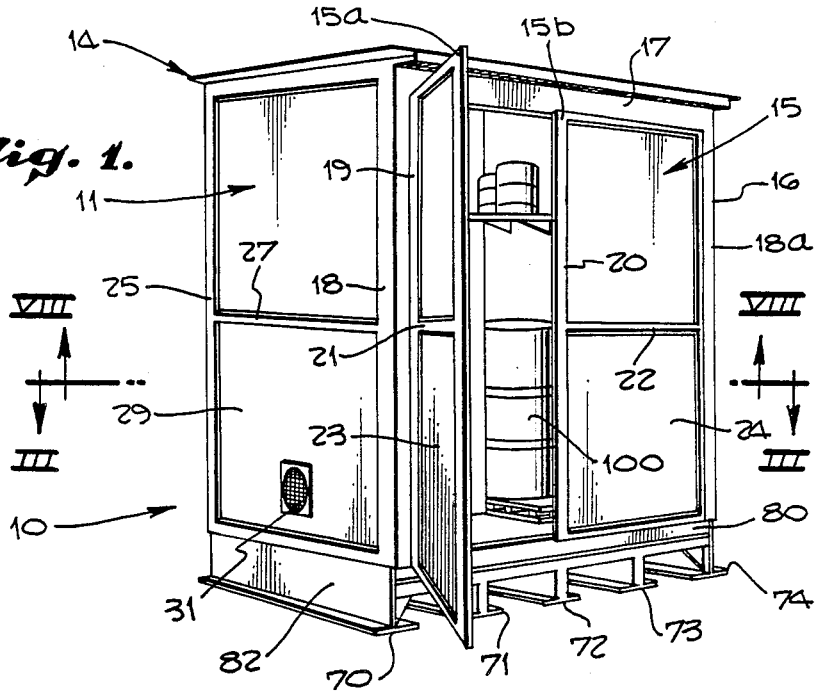
FIG. 1 is a frontal perspective view of an exemplary embodiment of storage enclosure for storing containers of hazardous material in accordance with the present invention.
Figure 2:
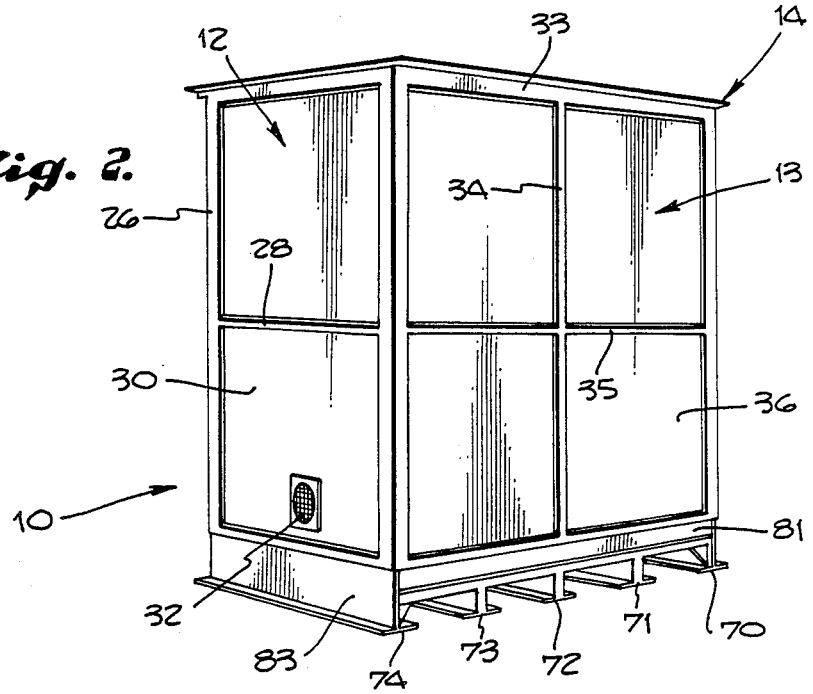
FIG. 2 is a rear perspective view of the storage enclosure of FIG. 1.

Referring now initially to FIGS. 1 and 2, the preferred exemplary embodiment of storage enclosure, in accordance with the present invention, includes a base, indicated generally at 10, left hand side wall indicated generally at 11, right hand side wall indicated generally at 12, rear side wall indicated generally at 13, a roof indicated generally at 14 and a front wall indicated generally at 15. As best seen in FIG. 1, a pair of doors 15*a* and 15*b* are provided in the front wall for access to the interior of the enclosure thus provided.

The enclosure front wall, indicated generally at 15, is fabricated of a front frame 16 fabricated from structural tubular steel members including header 17 and jams 18 and 18*a*. Appropriate hinges may be mounted to the jams 18 and 18*a* for mounting the doors 15*a* and 15*b* for swinging movement between opened and closed positions. Each of the doors 15*a* and 15*b* are also fabricated of structural tubular steel members, as seen in FIG. 1, of generally box configuration, as frames 19 and 20 in FIG. 1, each of which being provided with a cross brace 21 and 22 respectively. The door frames thus provided are welded or otherwise securely fastened to panels 23 and 24, each of which is preferably made of an approximately 14 gauge steel sheet.

The side walls, indicated generally 11 and 12 in FIGS. 1 and 2, are preferably fabricated from tubular steel members provided in a box frame, as left frame 25 and right frame 26, each such frame being further provided with a cross brace 27 and 28 respectively. Individual sheet steel panels 29 and 30, preferably on the order of 14 gauge sheet steel, are secured to the frames 25 and 26, as by welding, to provide for a very sturdy construction resisting unauthorized entry. Each of the side panels 29 and 30 is provided with a vent 31 and 32, each vent comprising simply an aperture through the associated panel with a heavy wire mesh screen covering the same.

The rear side wall, indicated generally at 13 in FIG. 2, comprises a rear wall frame 33 of tubular structural steel members of box configuration with vertical and cross braces 34 and 35 respectively, a single steel sheet 36 is secured to the rear wall frame 33, as by welding, to provide a solid impenetrable panel across the rear of the enclosure. The front, rear and side walls may be assembled to one another in a permanent fashion, as by welding of the various wall frame members to another in a permanent assembly.

Figure 4:
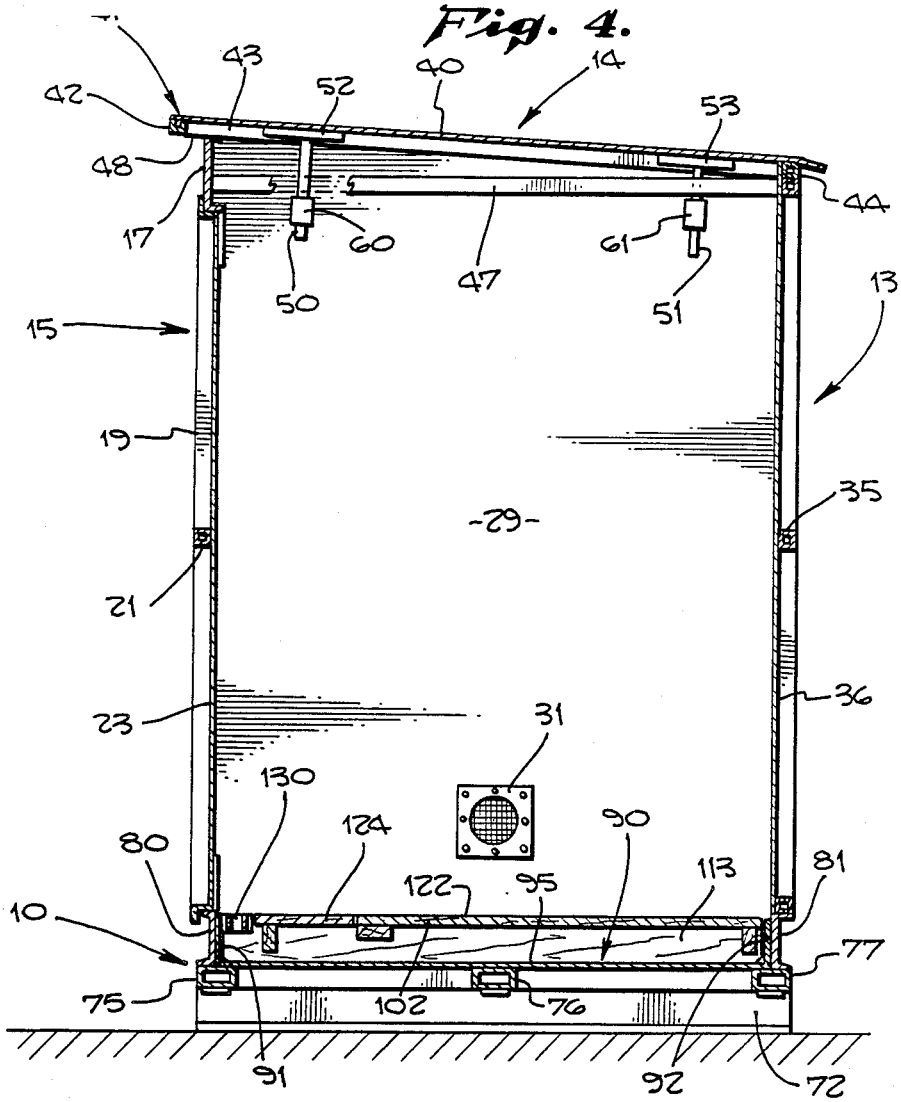
FIG. 4 is a vertical section view through the enclosures of FIGS. 1 through 3 taken along the plane IV—IV in FIG. 3.
Figure 8:
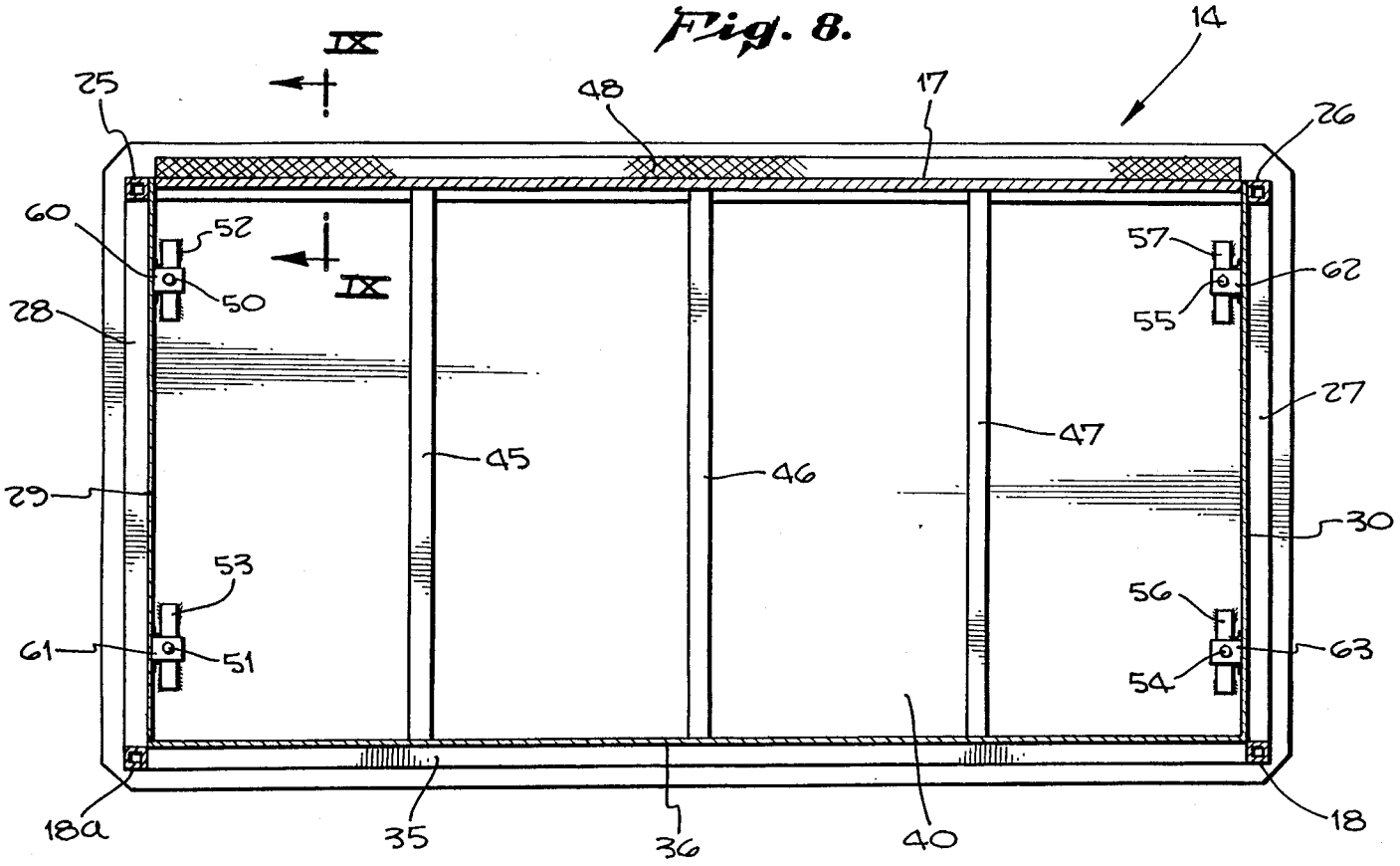
FIG. 8 is a horizontal section view, looking in an upward direction, of the enclosure of FIG. 1 taken therein along the plane VIII—VIII.

Referring now to FIGS. 4 and 8, the roof, indicated generally at 14, in the exemplary embodiment, comprises a panel 40 formed from a single sheet of steel, preferably of a 14 gauge thickness, which overlies a roof frame 41, as seen in FIG. 4 which includes four tubular steel side members, as side members 42, 43 and 44 in FIG. 4. Central portions of the roof frame are cross braced by the cross braces 45, 46 and 47 as seen in FIG. 8. It should be understood by those skilled in the art, that the roof frame includes four outer side frame members which form a box like construction with the central cross braces 45, 46 and 47 completing the roof frame to which the roof panel 40 is secured, as by welding. As best seen in FIG. 4, and detail view of FIG. 9, a roof frame extends outwardly of the front side wall frame 17 with portions of the roof over hanging the front wall. A heavy wire mesh screen 48 is provided along the over hang, as seen in FIGS. 4, 8 and 9, to provided for an air venting through the roof frame, beneath the roof panel 40 into the interior of the enclosure.

The roof, indicated generally at 14, has its roof frame, indicated generally 41, simply seated upon the upper portions of the enclosure front side and rear walls as seen in FIG. 4. Means are provided for retaining the roof to the enclosure subject to the roof being lifted off of the enclosure in response to an elevation of internal pressure of more than a predeterminable amount. In the exemplary embodiment, the roof frame is provided with a plurality of retention posts, as post 50 and 51 in FIG. 4 at opposite ends of the roof structure. The retention post, as post 50 and 51, may be secured by mounting blocks, as blocks 52 and 53 in FIG. 4, to the roof frame. Retention post 50 and 51, illustrated in FIG. 4, are also seen plan view in FIG. 8. The other end of the roof has retention posts 54 and 55 depending from mounting blocks 56 and 57. As seen in FIG. 8, the mounting blocks 52, 53 and 56, 57 may be secured to the under surface of the roof panel 40, as by welding.

Apertured retention blocks are provided on the side walls, as apertured blocks 60, 61, 62 and 63 in FIG. 8. Blocks 60 and 61 are also seen in FIG. 4, each of the blocks being mounted to a side wall panel, as by welding, to be aligned to and received therein the associated retention post. By sizing the diameter of the post and the internal diameter of the aperture of each of the retention blocks to provide a friction fit therebetween, a desired retention effect can be provided for the roof. In the present embodiment, such retention factor is provided so as to allow for a lifting off of the roof if and when an internal pressure of more than 0.047 psig is experienced within the enclosure.

Figure 5:
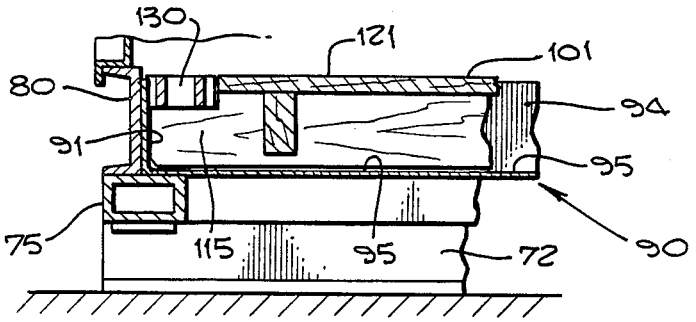
FIG. 5 is a detail section view of the enclosure of FIGS. 1 through 4 taken along the plane V—V in FIG. 3.

As is particularly contemplated within the present invention, the base, indicated generally at 10 includes a plurality of support beams providing a plurality of spaced support surfaces for the enclosure and its associated containment pan as subsequently described. Referring initially to FIG. 7, the base includes a plurality of inverted T channel members, including members 70, 71, 72, 73 and 74 which have upstanding webs relative a base flange as seen in end perspective view in FIGS. 1 and 2. Tubular steel support beams are provided laterally across the channel members 70–74, such beams including the support beams 75, 76 and 77 in the exemplary embodiment. The support beams 75, 76 and 77 provide a plurality of spaced support surfaces upon which the container pan is seated as subsequently described. The inverted T channel members 70–74 mount the support beams 75, 76 and 77 spaced above floor level to facilitate a forklift mobility for the enclosure. A plurality of side beams are also provided to provide a surrounding plurality of side surfaces extending vertically above the upper surfaces of the support beams 75, 76 and 77. In the exemplary embodiment, such side beams include the front side channel beam 80 as seen in FIGS. 4 and 5, and rear side channel beam 81 as seen in FIG. 4. Upper side walls 82 and 83, of the inverted T bars 70 and 74 as seen in FIGS. 1 and 2 provide end side walls and with the beams 80 and 81 provide a rectangular side wall enclosure of side surfaces extending vertically above the support beams 75, 76 and 77. The support beams and side walls thus provide a support frame work for receiving and supporting a containment pan therein.

As is also particularly contemplated within the present invention, the containment pan 90 as seen in FIG. 4, is initially fabricated from a single sheet of steel, as steel sheet 90*a* in FIG. 6. Marginal portions 91*a*, 92*a*, 93*a* and 94*a* are bent upwardly by known means relative a central bottom portion 95*a* with the four corners thus provided being welded closed. The one piece pan thus constructed is rested within the side walls of the base frame upon the support beams 75, 76, 77 as seen in FIGS. 4 and 7. The completed containment pan, indicated generally at 90 in FIGS. 4 and 7, is thus provided with a bottom 95 and surrounding walls 91 92, 93 and 94 in a one piece integral construction. Bottom portions of the containment pan may be viewed from beneath the enclosure by simply inspecting the same while looking between the channel members 70–73 and support beams 75–77 to ensure that there are no leaks through the containment pan.

Figure 3:
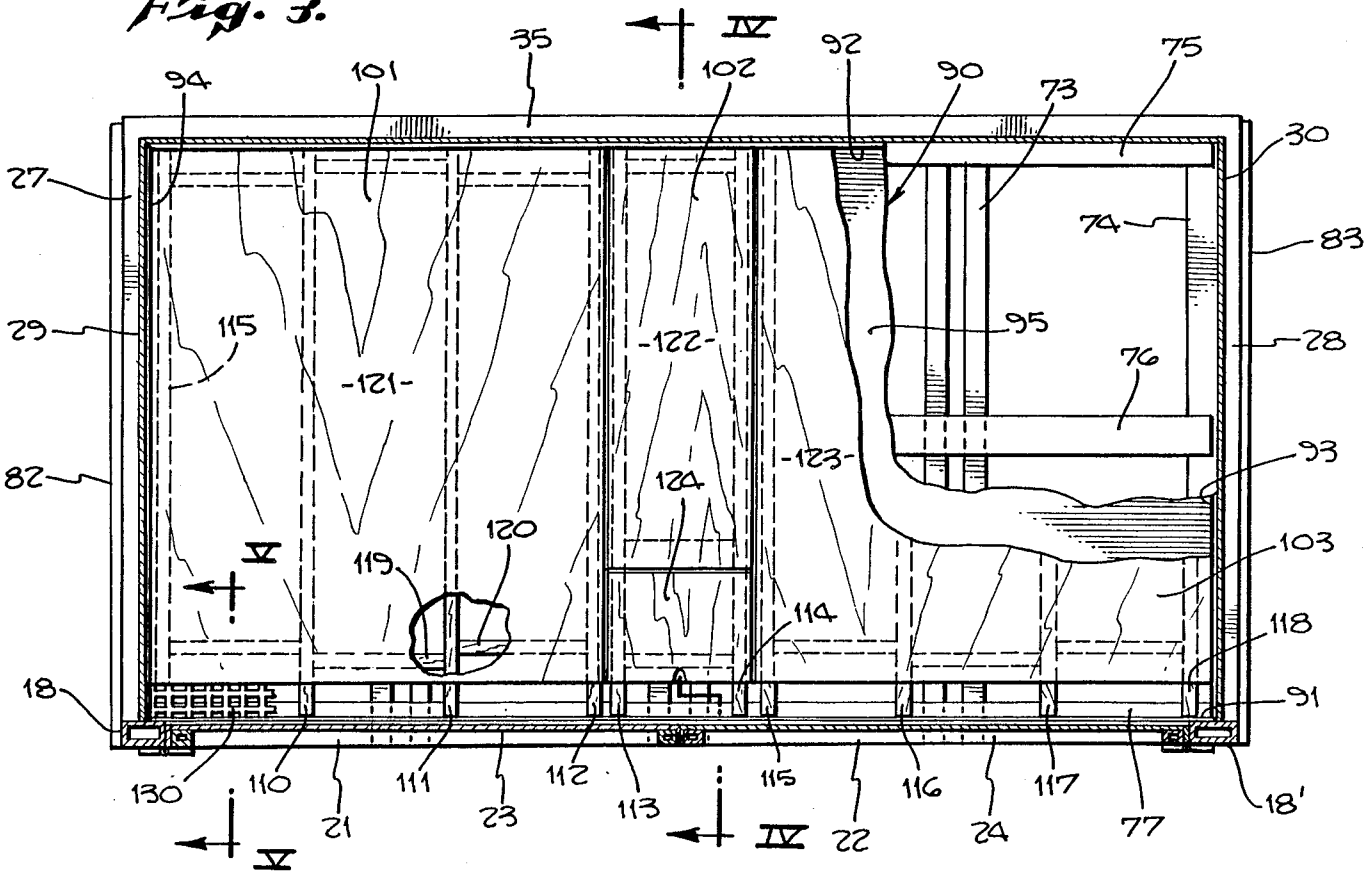
FIG. 3 is a horizontal section view of the enclosure of FIG. 1 taken therein along the plane III—III.

As is also contemplated within the present invention, a removable wooden platform floor structure is provided within the enclosure for providing a spark free support for containers, as container 100 as seen in FIG. 1, which are to be stored within the enclosure. As best seen in FIG. 3, the wooden platform floor structure includes a plurality of floor sections 101, 102 and 103. Each floor section is constructed of a plurality of support runners as runners 110, 111 and 112 of section 101, runners 113 and 114 of section 102 and runners 115, 116, 117 and 118 of section 103, each of the runners running from front to back of the enclosure and resting upon the bottom 95 of the containment pan 90 as seen in FIG. 4. Appropriate cross braces, as cross braces 119 and 120, are provided between the runners of each section to provide a rigid substructure for the floor facings. The floor facings 121, 122 and 123, as seen in FIG. 3, of the three sections overlie the support runners and ross braces and are secured thereto by gluing or other suitable means to provide individually removable sections. The support facing 122 of section 102 is interrupted by a removable floor facing section 124, as seen in FIGS. 3 and 5, which is removable to facilitate a visual inspection of the containment pan, indicated generally at 90, below the floor facing to determine whether any leakage or spillage from the containers within the enclosure has reached the containment pan, and, if the same has occurred, whether the level thereof warrants attention.

To facilitate such spillage or leakage from containers within the enclosure entering the containment pan, indicated generally at 90, a removable grate 130 is provided upon and extending over marginal end portions of the runners as seen in FIGS. 3, 4 and 5. The marginal end portions of the runners, as end portion 115*a* in FIG. 5, may be notched to facilitate receiving the removable grate 130 which, in the exemplary embodiment, is thicker than the floor facing 124.

It should now be apparent to those skilled in the art from a consideration of the foregoing detailed description of an exemplary embodiment of storage enclosure in accordance with the present invention, that a secondary containment is provided in the within invention in storage enclosure for containing and storing any hazardous materials which might spill or leak from containers stored within the enclosure. The secondary containment is provided by a one piece containment pan which assures the integrity of the containment provided thereby while the support beams providing an under carriage for the containment pan which permits visual inspection of the underside of the pan. A non-spark floor construction is provided for the containers and the roof structure is such that undue internal pressures can be relieved by the roof simply lifting off of the enclosure.

Having thus described a preferred exemplary embodiment of the present invention in storage enclosure, it should also be now apparent to those skilled in the art that various advantages and additional objects of the within invention have been afforded thereby and that various modifications, adaptations and other embodiments of storage enclosure may be made within the scope and spirit of the present invention which are defined by the following claims.

I claim:

1. A storage enclosure for storing containers of hazardous material and providing for a secondary containment of any spills or leakage of materials from said containers, said enclosure having a base, a containment pan having upstanding marginal portions relative a central portion, side and rear walls, a front wall having at least one front door and a roof, wherein:

said base includes a plurality of support beams providing a plurality of spaced support upper surfaces which are at least coextensive with said pan central portion in a first direction relative said pan and spaced relative each other in a second direction relative said pan and a plurality of side beams providing a plurality of side surfaces extending vertically upwardly of said support surfaces, said support surfaces and side surfaces together providing a support framework for receiving and supporting said containment pan with said pan central portion seated on and supported entirely across the underside thereof in said first direction and whereby portions of the pan are visible through spaces between said support surfaces in said second direction.

2. The storage enclosures of claim 1 wherein:

said containment pan comprises a single sheet of metal formed into a receptacle having integral pan bottom and surrounding upstanding pan side walls, said side walls comprising marginal portions of said sheet of metal which are bent upwardly relative a central portion of said sheet which provides said pan bottom.

3. The storage enclosure of claim 2 comprising:

a removable wooden platform floor structure including a plurality of floor sections, each section having support runners which rest on said receptacle bottom and a floor facing overlying all but marginal end portions of said runners, said marginal end portions runners being adjacent a side wall of said receptacle; and a removable grate provided upon and extending over said marginal end portions to facilitate passage of any spills and leakage of said containers into said container pan.

4. The storage enclosure of claim 3 wherein:

a portion of the floor facing on at least one of said floor sections is removable to provide for a visual inspection of said container pan beneath such one of said floor sections.

5. The storage enclosure of claim 1 wherein said side and rear walls are each fabrications of tubular steel wall frames each having a single sheet steel wall panel secured thereto.

6. The storage enclosure of claim 5 wherein said roof is a fabrication of a tubular steel roof frame and a single sheet steel roof panel.

7. A storage enclosure for storing containers of hazardous material and providing for a secondary containment of any spills or leakage of materials from said containers, said enclosure having a base, a containment pan, side and rear walls, a front wall having at least one front door and a roof, wherein:

said base includes a plurality of support beams providing a plurality of spaced support upper surfaces and a plurality of side beams providing a plurality of side surfaces extending vertically upwardly of said support surfaces, said support surfaces and side surfaces together providing a support framework for receiving and supporting said containment pan whereby portions of the pan are visible through spaces between said support surfaces;

said side and rear walls are each fabrications of tubular steel wall frames each having a single sheet steel wall panel secured thereto;

said roof is a fabrication of a tubular steel roof frame and a single sheet root panel; wherein said roof panel rests upon upper portions of said side frames;

a plurality of retention posts are provided on said roof frame, each such post depending therefrom; and a plurality of apertured blocks are provided on said wall panels and aligned individually to and receiving individual ones of said posts in a friction fit connection whereby said roof panel can separate upwardly of said side frames when internal pressure within said enclosure over comes said friction fit of said posts and apertured blocks.

8. The storage enclosure of claim 6 wherein portions of said roof frame overhang the front wall of said enclosure, said portions of said roof frame being covered by an air pervious metal wire mesh providing a air vent through said roof frame and below said roof panel into the interior of said enclosure.

9. The storage enclosure of claim 1 wherein:

side wall vents are provided in each of said side walls;

a portion of said roof overhand said front wall; and a roof vent is provided in said portion of said roof.

10. The storage enclosure of claim 1 comprising:

a plurality of inverted T channel members which have upstanding webs relative a base flange, some of said members being disposed below said beams and extending in said second direction to provide an underlying footing support for said beams.

11. The storage enclosure of claim 10 wherein:

others of said members are provided at outer ends of side beams with the associated upstanding webs thereof providing end side surfaces of said support framework for said pan.

12. A storage enclosure for storing containers of hazardous material and providing for a secondary containment of any spills or leakage of materials from said containers, said enclosure having a base, a containment pan, side and rear walls, a front wall having at least one front door and a roof, wherein:

said side and rear walls are each fabrications of wall frames and wall panels secured thereto;

said roof is a fabrication of a roof frame and a roof panel; and wherein:

said roof panel rests upon upper portions of said side frames;

a plurality of retention posts are provided on said roof frame, each such post depending therefrom; and a plurality of apertured blocks are provided on said wall panels and aligned individually to and receiving individual ones of said posts in a friction fit connection whereby said roof panel can separate upwardly of said side frames when internal pressure within said enclosure over comes said friction fit of said posts and apertured blocks.

13. A storage enclosure for storing containers of hazardous material and providing for a secondary containment of any spills or leakage of materials from said containers, said enclosure having a base, a containment pan, side and rear walls, a front wall having at least one front door and a roof, wherein:

said base includes a plurality of support beams providing a plurality of spaced support upper surfaces and a plurality of side beams providing a plurality of side surfaces extending vertically upwardly of said support surfaces, said support surfaces and side surfaces together providing a support framework for receiving and supporting said containment pan; and said containment pan comprises a single generally rectangular sheet of metal formed into an upwardly opening rectangular box like receptacle having integral pan bottom and surrounding upstanding pan side walls, said side walls comprising marginal portions of said sheet of metal which are bent upwardly relative a central portion of said sheet which provides said pan bottom, only four corners of said receptacle thus formed being welded closed where adjacent ones of said marginal portions about one another, said receptacle bottom being seated upon said plurality of spaced support upper surfaces and said receptacle side walls abutting against said plurality of side surfaces whereby said receptacle is cradled by said framework.

* * * * *

UNITED STATES PATENT AND TRADEMARK OFFICE

CERTIFICATE OF CORRECTION

PATENT NO. : 4,875,595

DATED : October 24, 1989

INVENTOR(S) : N.L. Van Valkenburgh

It is certified that error appears in the above-identified patent and that said Letters Patent is hereby corrected as shown below:

On the title page, under item [19] and in item [76]:

Please change the name of the inventor from "Valkenburg" to --Valkenburgh--.

Signed and Sealed this

Fifth Day of March, 1991

*Attest:*

HARRY F. MANBECK, JR.

*Attesting Officer*

*Commissioner of Patents and Trademarks*